US005715954A

United States Patent [19]

Zaremba

[11] Patent Number: 5,715,954

[45] Date of Patent: Feb. 10, 1998

[54] REMOVABLE DISPLAY ATTACHMENT FOR VERTICAL RIGID CYLINDRICAL SUPPORTS

[76] Inventor: George Julian Zaremba, 6630 N. Kostner, Lincolnwood, Ill. 60646

[21] Appl. No.: 587,009

[22] Filed: Jan. 16, 1996

[51] Int. Cl.[6] ..... A47F 5/08

[52] U.S. Cl. ..... 211/107; 211/131; 220/23.83

[58] Field of Search ..... 211/107, 131, 211/133, 144; 220/475, 23.83, 23.86; 206/503

[56] References Cited

U.S. PATENT DOCUMENTS

| | | | |
|---|---|---|---|
| 1,570,651 | 1/1926 | Topping et al. | 211/131 X |
| 1,955,919 | 4/1934 | Kress | 220/23.83 X |
| 2,103,684 | 12/1937 | Long | 220/475 X |
| 2,289,212 | 7/1942 | Rinnela | 211/131 |
| 2,883,066 | 4/1959 | Pratt | 220/23.83 |
| 3,332,654 | 7/1967 | Jacobson | 211/107 |
| 3,398,827 | 8/1968 | Laskin | 220/23.83 X |
| 3,642,263 | 2/1972 | Pine et al. | 220/23.83 X |
| 4,311,237 | 1/1982 | Hayes | 206/503 |
| 4,501,201 | 2/1985 | Fitzner et al. | 211/107 X |
| 5,279,429 | 1/1994 | Sagel | 211/131 |
| 5,312,003 | 5/1994 | Domenig | 211/131 X |
| 5,458,243 | 10/1995 | McBride | 220/23.83 X |

*Primary Examiner*—Leslie A. Braun
*Assistant Examiner*—Sandra Snapp
*Attorney, Agent, or Firm*—Adrienne B. Naumann

[57] ABSTRACT

A spatially and mechanically independent donut bowl structure is provided. The preferred embodiment consists of a flat member surrounded by an upwardly rising rim and an upwardly protruding open tubular segment on the upper surface. The opening completely pierces the donut bowl, so that a pole or pipe can easily slide through the invention. The donut support can be used by itself as a small dish. It can also be used interchangeably as a versatile, lightweight, and inexpensive container or tray component to any variety of decorative displays using poles, pipes, or pedestals.

19 Claims, 6 Drawing Sheets

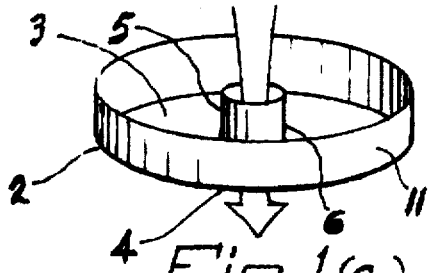
Fig 1(a.)
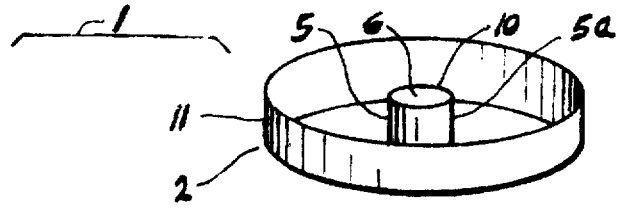
Fig 1(b.)
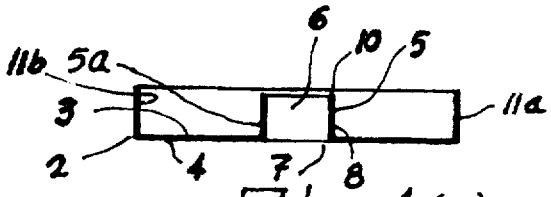
Fig 1(c.)
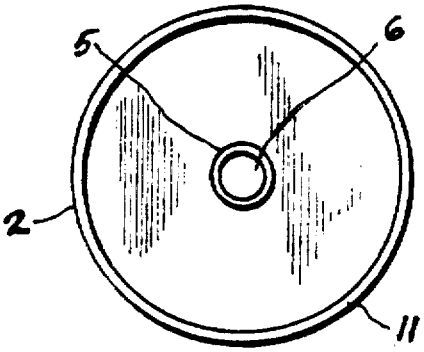
Fig. 2
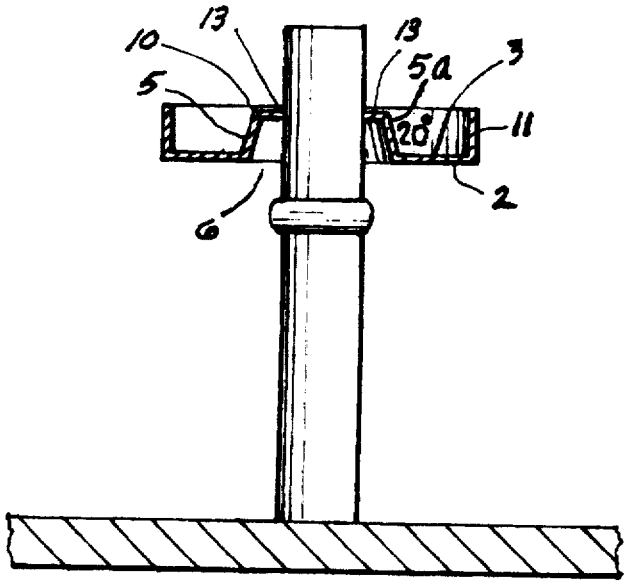
Fig. 4
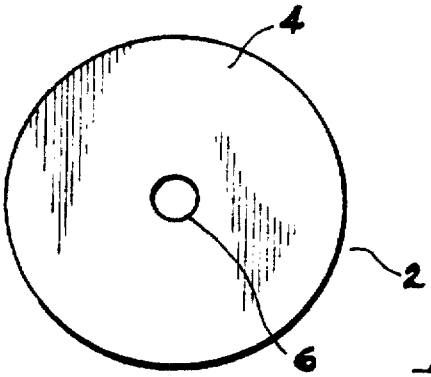
Fig. 3

REMOVABLE DISPLAY ATTACHMENT FOR VERTICAL RIGID CYLINDRICAL SUPPORTS

BACKGROUND OF THE INVENTION

The present invention relates to a structure which functions as a removable container for decorative arrangements. More particularly, the present invention, hereinafter referred to as the display attachment, relates to an object with a raised open tubular segment which may hold a multitude of decorative objects. Display attachments can be at the bottom of a pole, as a shelf at the top of a pole, or at any other vertical height in between the two ends of a pole, standing at right angles to a flat, horizontal surface.

There has been a long-standing need in the decorative industry for a movable or mobile container for displays of decorative objects which is inexpensive and fit over standard sized pedestals, pipes or poles. In the prior art, decorators used an attachment glued to a bottom container to support a pole. A pole would fit over this attachment, thus being held vertically. The top of the pole could also hold a shelf or container if attached with glue. However, none of the previous display components have an open protruding circular segment which is easily positioned along a standard sized (diameter) plexiglass pole, either as (i) a bottom base or container with can hold decorative objects; (ii) a container positioned along a pole or (iii) as a top shelf or container.

SUMMARY OF THE INVENTION

To solve this long-standing problem in the art, the present invention, the display attachment, provides an improved integral component for any decorative combination comprising a standard plexiglass pole. Other types of poles, such as resinous, wooden, or metal, are also contemplated within the scope of my invention. In my preferred embodiment the plexiglass pole has a diameter of one inch, one and a quarter inch, or one and one half inch in diameter and can be best described as an "off the shelf" item.

The user can manually arrange separate display attachments and attach them to a pole in seconds. My invention functions as a bowl and can be used on any vertical pole, pipe, pedestal or similar device.

Accordingly, an object of the present invention is to provide an improved, more versatile container for decorative arrangements which facilitates creativity as well as assembly.

Another object of the present invention is to provide an improved stronger, yet lightweight bowl made from durable low cost plastic to support decorative arrangements.

Yet another object of the present invention is to provide a one piece article with a raised rim and open protruding tubular segment which can be assembled in combination without gluing means.

A further object of the invention is to provide a bowl which the user can attach to a standard diameter plexiglass pole at any vertical height, or at the top or bottom of the pole.

Yet another object of the invention is to provide a flat bottomed bowl-like container.

Another object of my invention is the convenience of removing a bowl and giving it to another party, thus saving the more expensive pole or pedestal for subsequent use.

Another object of the invention is to create bowls as display devices which can be easily stored.

These and still other objects and advantages of the invention will become apparent from the following description of the preferred embodiment of my present invention, as well as other embodiments.

BRIEF DESCRIPTION OF THE DRAWINGS

My invention may be better understood by reference to the drawings accompanying this specification:

FIGS. 1A, 1B and 1C is a slightly tilted side view of the display attachment demonstrating the upwardly extending tubular segment, when the invention is resting on a flat horizontal surface.

FIG. 2 is a plan view of the upper surface of the display attachment, showing the opening in the upwardly extending tubular segment.

FIG. 3 is a plan view of the lower surface of the display attachment.

FIG. 4 demonstrates a cross section of the invention with an upper interior lip.

DETAILED DESCRIPTION OF THE INVENTION

Figure 5:
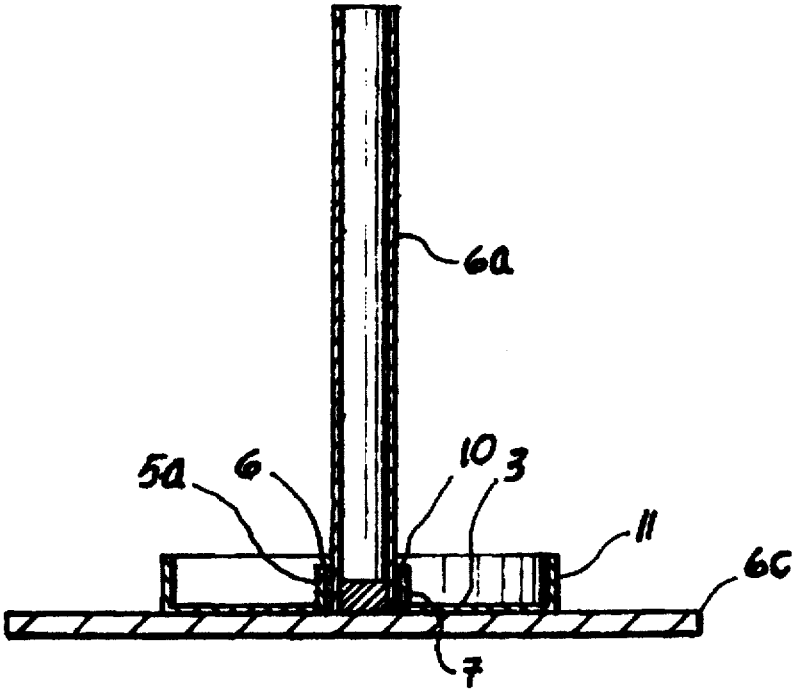
FIG. 5 demonstrates a cross section of the invention without any lip.

The present invention, hereinafter referred to as "the display attachment" 1 is actually an article of manufacture with a flat basic member 2. This member has a top surface 3 and bottom surface 4. Extending upwardly from the top surface 3 is an open tubular segment 5 with a continuous wall 5*a*. The tubular segment 5 is open in such a manner that the top and bottom surfaces of the display attachment coextensively have an opening 6, through which a second object, such as a pipe, pedestal or pole may pass. Tubular segment 5 has a predetermined height and that height has a midpoint. The entire display attachment is rigid in the preferred embodiment, although more flexible embodiments are also within the scope of my invention.

In the preferred embodiment, the lower edge 7 of the tubular segment wall 5*a* is contiguously molded to and at right angles with the upper surface 3. The tubular segment also has an exterior surface 8 and an interior surface 9. Tubular segment 5 has an uppermost edge 10.

Also extending upwardly from the upper surface 3, and at right angles to this surface 3 is a rim 11. The rim may or may not be the same height as the upper edge 10 of open tubular segment 5. The rim has an outer surface 11*a* and an inner surface 11*b*. Surface 3 extends from the bottom 7 of tubular segment 5 to rim 11, so that rim 11 forms the periphery of flat member 2.

In the preferred embodiment, the display attachment 1 is round, but may be any shape within the scope of my invention. Also in the preferred embodiment of my invention, the open tubular segment is concentrically placed within the top surface 3. However, other positions of the tubular segment within the flat member 2 of the preferred embodiment are also contemplated, assuming there is no balance problem. The preferred embodiment contemplates a tubular segment which is cylindrical in shape. Again, however, my invention contemplates tubular segments which are larger, narrower, or of different shapes.

In the preferred embodiment, the round bottom member 2 is approximately six inches in diameter. The open tubular segment is approximately one inch in height from the upper surface of the bottom member. The circular opening within the tube segment is approximately one and one half inch in diameter. The circular rim 11 is approximately one and one half inches in height from the bottom surface 4 of the donut bowl. Other measurements and dimensions are also contemplated within the scope of this invention, however. The preferred thickness of the rim 11 is approximately one-eighth of an inch, but again, thickness can vary.

In the preferred embodiment, my display attachment can slide over a standard plexiglass pole 6*a* to function as a bottom support or container for a display. This function is particularly useful if the tubular segment is facing upwardly, so that the donut can function as a bowl. In this position my invention can also be is filled with a heavy substance such as plaster, cement, sand, or pebbles, so the display has greater physical stability.

My invention also functions without combination with a pole, pipe, pedestal or similar device. For example, on a flat surface, with the tube segment facing upward, and thus having the availability of the rims, it can be filled with candy, party favors, small decorative objects or other memorabilia.

To operate my invention in combination with a pole, pedestal or pipe, the pole (for example)is pushed through the hole in the tubular segment. On a vertical pole, besides being positioned at the bottom of the pole as a base or container, or at the very top of the pole as a container or shelf, the display attachment can also be aligned with O-rings along the pole vertically.

In addition, the display attachment can be positioned on a pole with the tubular segment either facing the supporting surface, such as a table or floor, or upwardly. In this manner the display attachment can be used as a perfectly flat surface without rims, and be used to support small items, function as a tray, or simply as decoration.

In the alternative, a plurality of attachments can be placed on a display vertically along a pole component supported by O-rings, wedges, and variations to the structure of the invention, and with the tubular segments facing upwardly from a horizonal surface.

FIGS. 1(*a*),(*b*),(*c*) illustrate the preferred embodiment of the invention. The display attachment 1 comprises a rim 11, and top and bottom surfaces 3 and 4 respectively of flat member 2. The tubular segment 5 is shown facing upwardly from top surface 3.

FIG. 2 is a plan view looking down on the tubular segment 5. The preferred embodiment is shown, with a circular flat member 2, tubular segment 5 concentrically located, and opening 6 piercing bottom surface 4 of the invention(not seen in this view).

FIG. 3 is a plan view of the bottom surface 4 of the flat member 2 of the invention. The opening 6 can be seen in this view as well as in FIG. 2, as opening 6 completely penetrates member 2 of the invention.

FIG. 4 is a cross-sectional view of the display attachment positioned along a pole, pipe, pedestal or similar device in the preferred embodiment. From this view one can see an interior lip 13 which contiguously connects at all its points to upper edge 10 of tubular segment 5. The lip is oriented interiorly towards the center of opening 6 of tubular segment 5. In this figure one observes the lip grasp the pole which transverses the display attachment through opening 6. The wall 5*a* of tubular segment 5 diverges from the vertical approximately 20 degrees, thus giving the display attachment more space to slide along the pole to a vertical position.

Also in FIG. 4, one can see that no less than one generic rubber O-ring 15 is positioned immediately below the donut bowl. Such O-rings are for supplemental support to prevent sliding and slipping, and they work in tandem with the interior lip of the actual invention. O-rings, in different varieties, are also considered an "off the shelf" item in the industry and are easily obtainable at for example, a lumber yard or hardware store.

FIG. 5 illustrates the invention in cross-section, without any lip, at the base of a pole or pedestal oriented 90 degrees from a horizontal surface. Similarly, there is no divergence from the vertical, because there is no support or sliding problem: the invention grips the end of the pole 6*a* and rests on the horizontal surface 6*c*.

Figure 6A:
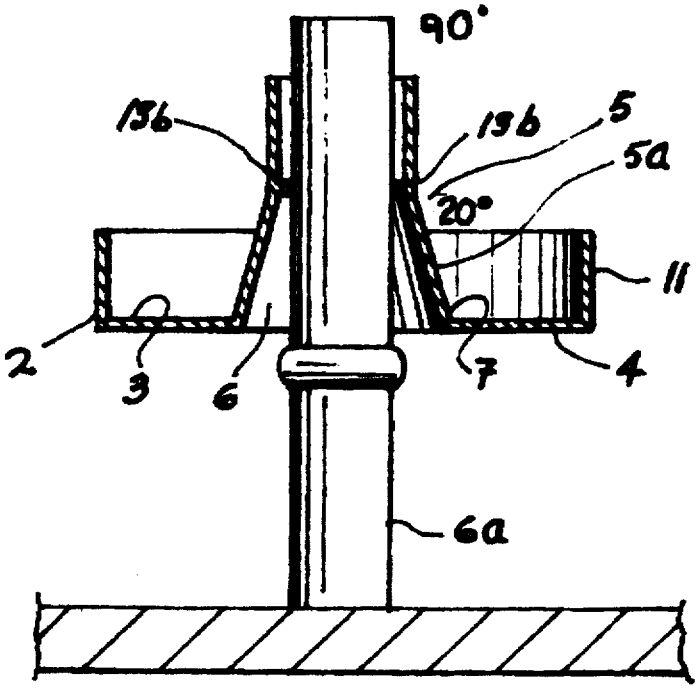
FIGS. 6A and 6B demonstrates a cross section of a third embodiment of the invention.
Figure 6B:
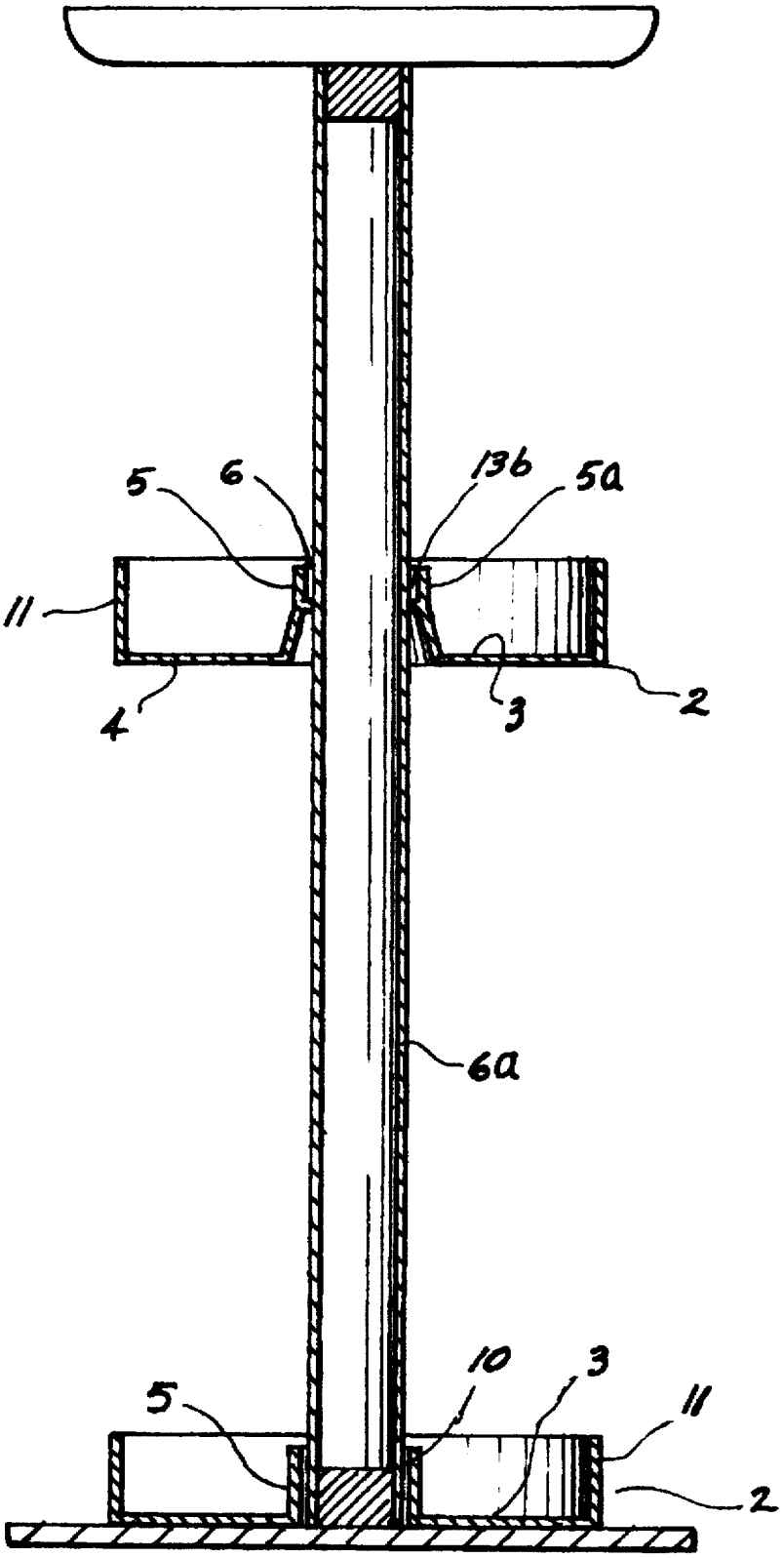

FIGS. 6*a* and 6*b* illustrate cross sections of a third embodiment of my invention. As before, this figure reveals an O-ring 15 which braces my invention along a vertical pole, pedestal, or pipe. In this embodiment, however, the lip 13(*b*) is located midway between the top edge 10 and the bottom edge 7 of tubular segment 5. The top attachment in FIG. 6B can be connected and supported with an adhesive. However, for an attachment in an imtermediate postion along a pole, the inner diameter of the lip should be slightly greater than the outer diameter of the pole. In this manner, the attachment can slide loosely down the pole to its intended position. Lip 13(*b*), as is lip 13, is oriented interiorly toward the pole to grasp it and hold the display attachment at a particular vertical height. Here, the divergence of 20 degrees from the vertical, begins at the medially located lip. The wall 5*a* of the tubular segment 5 above the lip retains vertical orientation with respect to the horizontal surface upon which the pole rests.

Again, the lip and accompanying O-rings, as well as the light weight of my invention, contribute to the lack of slippage after the bowl is initially positioned. The top half above the lip should be a tight fit. The bottom half should be a loose fit to the pole to leave room for an O-ring. The tighter fit of the top half of the tubular segment can also be achieved by a smaller diameter at 5*a* as illustrated. An alternative approach comprises vertical ridges which decrease the diameter of tubular segment 5 for a tighter fit. Such ridges would be molded to the interior surface 8 of the top half of the tubular segment wall 5*a*.

Different sizes and shapes of my invention can be used along the pole with modification of these features, such as additional O-rings, or a wider lip, either at the top edge or at the midpoint of tubular segment 5.

Figure 7:
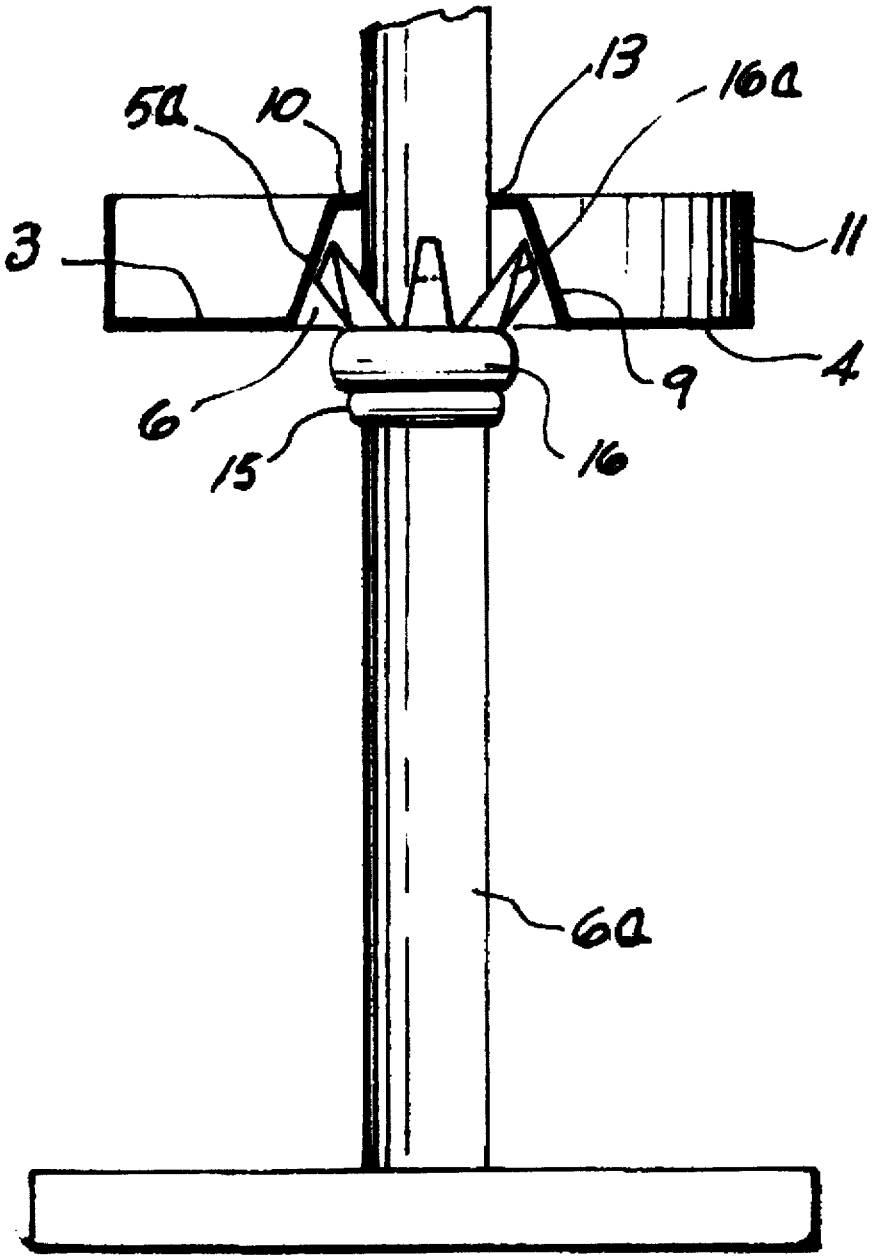
FIG. 7 demonstrates a cross section of a fourth embodiment with an additional separate component.

FIG. 7 illustrates a cross-section of my display attachment in another embodiment with an additional physically separate component. Again, the O-rings 15 assist in bracing my invention. The display attachment may have lip 13 or lip 13*b* as stated previously, with appropriate divergence of the tubular segment wall 5. Immediately beneath the bowl is a rigid ring comprised of plastic 16. This ring in turn has three or four wedges 16*a* injection molded to the ring and spaced equidistantly from each other. The wedges 16*a* are triangular and of a size sufficient to fit snugly within the spaces created by the divergence of the tubular wall from either a medially or uppermost located lip. In this matter, any "wobble" created by the divergence of the tubular wall 5*a* from the vertical is sufficiently prevented, so that the bowl and the ring's wedges function as a stable, functional unit.

Figure 8A:
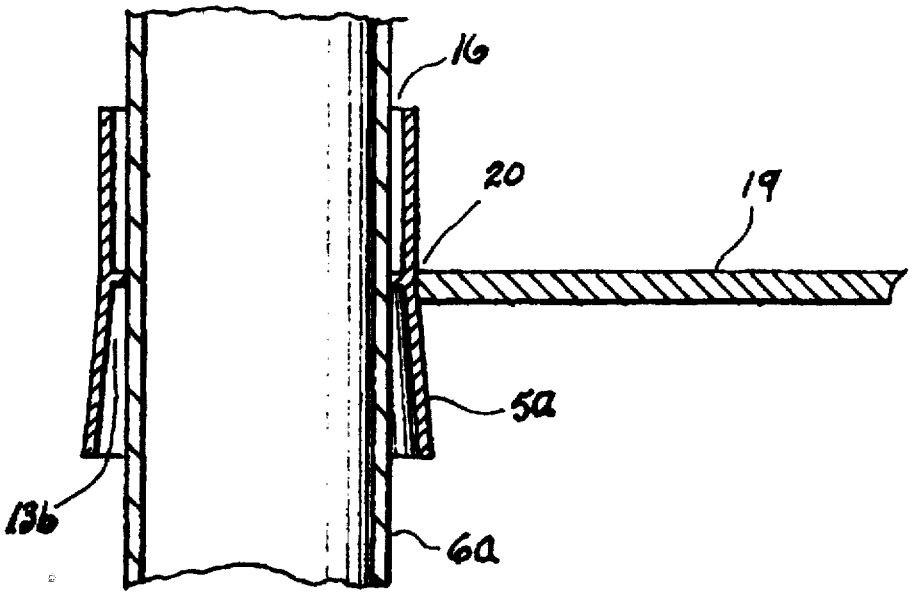
FIGS. 8A, 8B and 8C demonstrates a cross section of the invention with a lip on the uppermost edge of the interior surface of terminating in lateral arms with small containers.
Figure 8B:
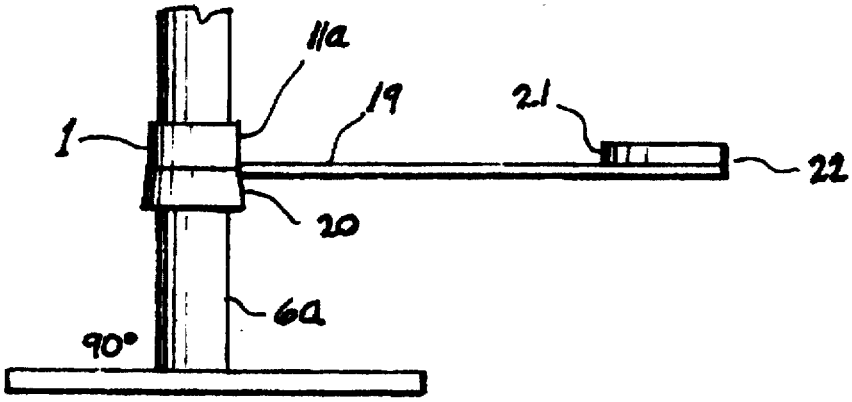

FIGS. 8(*a*),(*b*),(*c*) illustrate my display attachment with lateral arms positioned on a pole, pipe, or pedestal. The O-ring 15 assists in bracing my invention as in the previous embodiments. Here, the display attachment are modified to comprise integrally molded extending arms 19 with a first end 20 and a second end 21. End 21 is most distant from the pole 6*a* and parallel to the horizontal surface on which the pole stands at a ninety degree angle. The pole can be supported horizontally by another display attachment 23.

Figure 8C:
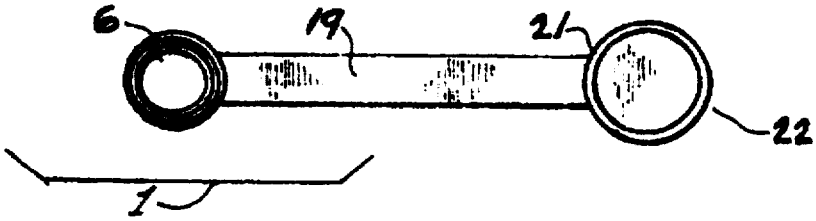

The first end 20 is integrally molded to the rim outer surface 11*a*. The arm 19 extends parallel to the horizontal surface and terminates in a small, lightweight container 22. This container 22 is integrally molded to the end of the arm 21. Container 22 can hold a votive candle or other decorative means. This arrangement can be repeated for the entire vertical length of the pipe, pedestal or pole. FIG. 8C is a plan view of this embodiment with a lateral arm. The diameter of the basin at the far end of the arm is approximately three inches in the preferred embodiment.

Figure 9A:
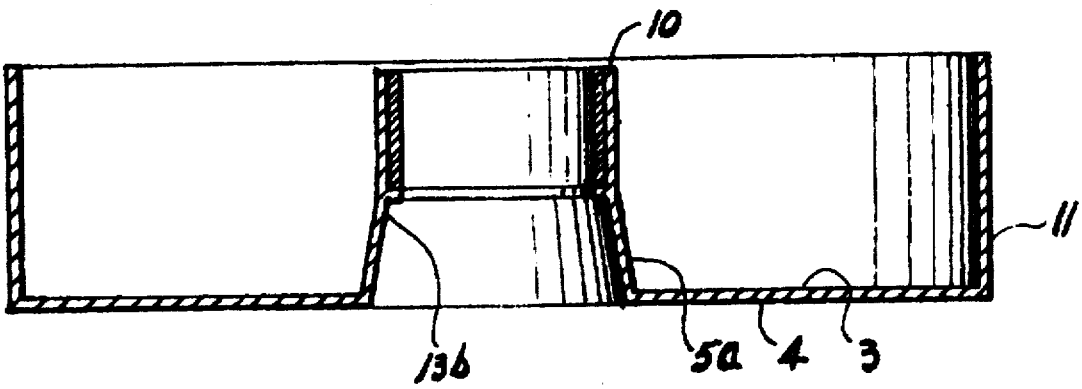
FIGS. 9A and 9B illustrates the addition of protruberances within the tubular segment of the invention.
Figure 9A:
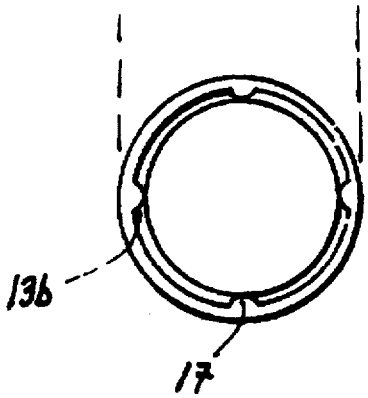
Figure 9B:
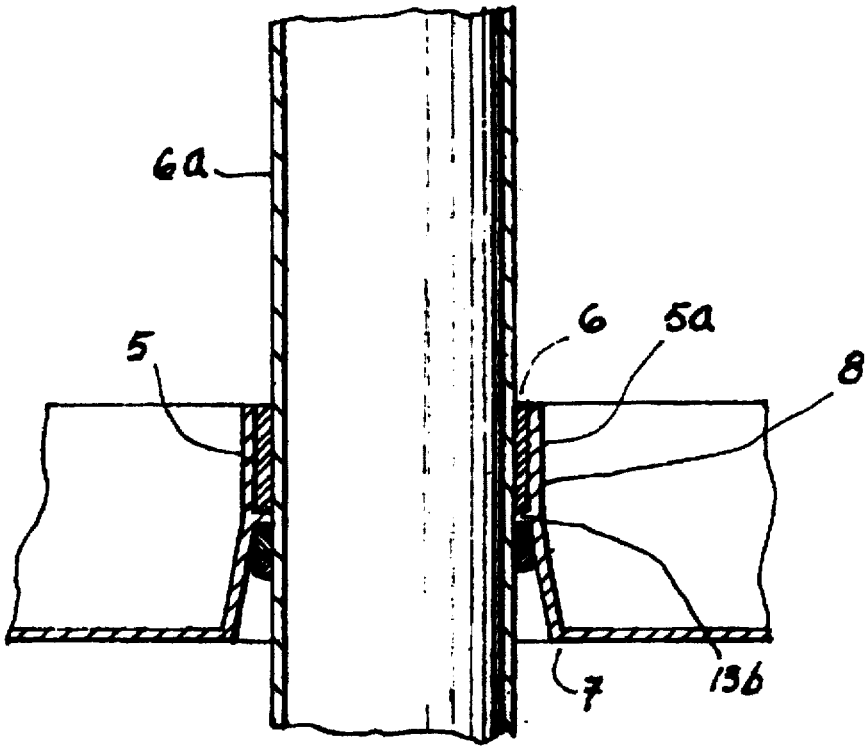

FIGS. 9(*a*),(*b*) illustrated yet another variation to my embodiments in which small protuberances 17 are molded to the interior wall 8 of tubular segment 5. The protuberances 17 are the same thickness as the lip 13 or 13*b*, and are equidistant from each are as seen in cross section as seen in FIG. 9(*a*). The protuberances can be located immediately below the lip either at the middle or top position as seen in FIG. 9(*b*).

The economics of my display attachment are remarkable. With what is now available in the industry, to assemble a similar display with glue and then remove a portion and give it to a second party is very expensive. Such displays may cost from six to eight dollars apiece when the entire combination is given away without compensation to a third party.

The display container, however, is an inexpensive liner and waterproof container to give, for example to customers, and only costs approximately eighty cents apiece to produce. This is of particular value in the floral display segment of the industry, in which flowers are often given as party favors, after festivities have ended.

The display container is generally integrally molded of inexpensive plastic, but other materials are contemplated within the scope of this invention. The molding process is standard, and one generally well recognized in the plastics industry by those skilled in the art. As can be seen from the above descriptions, one of the most crucial features of my invention is the versatility of the bowl-like object. This is because of the variety of structural means to both manually slide a bowl onto a pipe, pole or pedestal easily, and then have it remain in the intended position without glue or undue cumbersome supports. It can function at any height or with the tube segment facing upwards or towards the floor. In sum, my invention is versatile, inexpensive, easily stored, and does not require an adhesive.

What I claim is:

1. For displaying objects on a vertical rigid cylindrical support by removably encircling said support, a display attachment comprising (a) a flat member, said member having a top and bottom surface (b) a tubular segment, said tubular segment further comprising (i) an upper edge and lower edge (ii) a contiguous wall completely connected at all points to said top surface of said flat member at said lower edge, said wall of a predetermined height and thickness (iii) an exterior and interior surface to said contiguous wall, said interior surface further comprising a series of midpoints (iv) said segment further containing an opening contiguous from said top surface to said bottom surface of said flat member (v) said segment extending upwardly from said top surface, (c) a rim, said rim having a top edge and a bottom edge, (i) said rim's bottom edge continuous with said top surface of said flat member (ii) said rim having an inner and outer surface (iii) said rim comprising a wall with a predetermined thickness (iv) said rim having a predetermined height (d) a rigid ring comprising a plurality of wedges (i) said ring having an upper surface and a lower surface, (ii) said wedges protruding upwardly from said upper surface of said ring (iii) said wedges spaced approximately equidistantly apart along said plastic ring whereby said ring encircles a vertical rigid cylindrical support while positioned immediately below said flat member, and said wedges fit snugly into spaces created between said vertical cylindrical rigid support and said tubular segment when said display attachment encircles said support.

2. The display attachment as defined in claim 1 wherein said rigid cylindrical vertical support is a plexiglass pole.

3. The display attachment as defined in claim 1 wherein said attachment is comprised of durable low cost plastic.

4. The display attachment as defined in claim 1 wherein said wedges are injection molded to said plastic ring.

5. The display attachment as defined in claim 1 wherein there is an additional ring without wedges whereby said additional ring is positioned immediately below a ring with wedges.

6. A display attachment as described in claim 1 further comprising (a) a lateral arm (i) said arm having a first end integrally connected to said rim and a second end most laterally distant from said rim (iii) said arm parallel to a horizontal surface (iv) said second end terminating in a small container intimately attached to said second end whereby said small container is attached to said arm, and said arm attached to said rim of said display attachment.

7. The display attachment as described in claim 1 wherein said tubular segment has a smaller diameter at said upper edge than along said wall.

8. The display attachment as described in claim 1 wherein said wedges on said plastic ring are polygons with triangular sides.

9. The display attachment as described in claim 1 wherein there are three said wedges.

10. The display attachment as described in claim 1 wherein there are four said wedges.

11. The display attachment as described in claim 1 wherein there are three pyramidal wedges equidistantly spaced from each other.

12. The display attachment as described in claim 1 where said rings are O-rings.

13. The display attachment as described in claim 1 wherein said attachment comprises a basin.

14. The vertical display attachment as described in claim 1 wherein a plurality of said bowls comprise containers on a pole, pedestal or pipe.

15. A display attachment as described in claim 1 comprising (a) a flat member, said member having a top and bottom surface, (i) said member being circular in shape (ii) said member being approximately six inches in diameter, (b) a tubular segment, said tubular segment being cylindrical in shape, said tubular sediment positioned concentrically upon said top surface of said base member, said tubular segment further comprising (i) an upper edge and lower edge (ii) a contiguous wall completely connected at all points to said top surface of said flat member at said lower edge, said wall of a predetermined height and thickness, (iii) an exterior and interior surface to said contiguous wall, (iv) said segment further containing an opening contiguous from said top surface to said bottom surface of said member (v) said segment extending upwardly from said top surface, (vi) said segment being approximately one inch in height from said upper surface of said base member, said opening being approximately one and one half inch in diameter, (c) a rim (i) said rim being contiguous with said flat member at all points, (ii) said rim having an inner and outer surface (iii) said rim comprising a wall with a predetermined thickness of approximately one eighth of an inch, (iv) said rim having a predetermined height of approximately one and one half inches (v) said rim having a top edge and a bottom edge whereby said flat member integrally attaches to said tubular segment on said top surface, said segment extending upwardly from said top surface, said flat member co-extensive with said bottom edge of said rim.

16. The display attachment for a vertical cylindrical rigid support as described in claim 1 wherein said attachment encircles and contacts a vertical pole, pipe, pedestal or similar cylindrical rigid vertical support and said tubular segment further comprising (a) a lip oriented towards the center of said opening of said tubular segment (i) said lip integrally attached at all points to said top edge of said tubular segment, said lip of a predetermined width, (b) said wall of said tubular segment further comprising a predetermined divergence from the vertical, beginning at said lip as measured from a horizontal surface on which said vertical cylindrical rigid support rests, whereby said lip can grasp the surface of said pipe, pole or pedestal within said tubular segment, while said diverging wall allows additional space to manually slide said attachment along said vertical cylindrical rigid support.

17. The display attachment as defined in claim 1 for a vertical cylindrical rigid support wherein said attachment encircles and contacts said vertical rigid cylindrical Support, and wherein said tubular segment comprises a series of midpoints on said interior wall, said tubular segment further comprising (a) a lip completely contiguous to the interior surface of said tubular segment, (i) said lip oriented towards the center of said contiguous opening of said tubular section (ii) said lip positioned at said midpoints (b) said wall diverging from the vertical, as measured by said vertical rigid cylindrical support at 90 degrees from a horizontal surface, by approximately 20 degrees beginning at each said midpoint and terminating upon the upper surface of said flat member, (i) said wall remaining approximately vertical beginning at said midpoint to said top edge of said wall whereby said wall's divergence from the vertical at said midpoint creates spaces between said tubular segment and said vertical rigid cylindrical support which facilitates manually sliding said display attachment to the desired vertical position.

18. The display attachment as defined in claim 1 wherein said attachment comprises a bowl.

19. The donut bowl as defined in claim 15 wherein said bowl is a bottom support filled with a heavy material.

* * * * *